US005243150A

United States Patent [19]

Bank et al.

[11] Patent Number: 5,243,150

[45] Date of Patent: Sep. 7, 1993

[54] RIBBON TRANSDUCERS

[76] Inventors: Graham Bank, 15 Mayfield Lane, Martlesham, Ipswich, Suffolk; Harold C. Pinfold, deceased, late of Elstree; by Laurence P. Ross, executor, 35, Barham Avenue, Elstreet, Hertfordshire, all of England

[21] Appl. No.: 944,023

[22] Filed: Sep. 11, 1992

Related U.S. Application Data

[63] Continuation of Ser. No. 540,952, Jun. 20, 1990, abandoned.

[30] Foreign Application Priority Data

Jun. 21, 1989 [GB] United Kingdom ..... 8914241

[51] Int. Cl.[5] ..... G10K 13/00

[52] U.S. Cl. ..... 181/166; 181/171; 181/172

[58] Field of Search ..... 181/166, 171, 172; 381/188, 193, 203, 205

[56] References Cited

U.S. PATENT DOCUMENTS 3,837,425 9/1974 Bozak ..... 181/166
4,461,932 7/1984 Oyaba ..... 181/166 X

FOREIGN PATENT DOCUMENTS 0116957 8/1984 European Pat. Off. .
852006 10/1960 United Kingdom .
1493296 11/1977 United Kingdom .

*Primary Examiner*—Michael L. Gellner
*Assistant Examiner*—Khanh Dang
*Attorney, Agent, or Firm*—Seidel, Gonda, Lavorgna & Monaco

[57] ABSTRACT

A ribbon transducer has the ends of its ribbon held by end fixings which incorporate damping member. The end fixing may include a resilient support member fixed to the ribbon, with the ribbon overlying a pad of damping material and having its outer end held clamped, or alternatively left free.

10 Claims, 1 Drawing Sheet

FIG. 1.
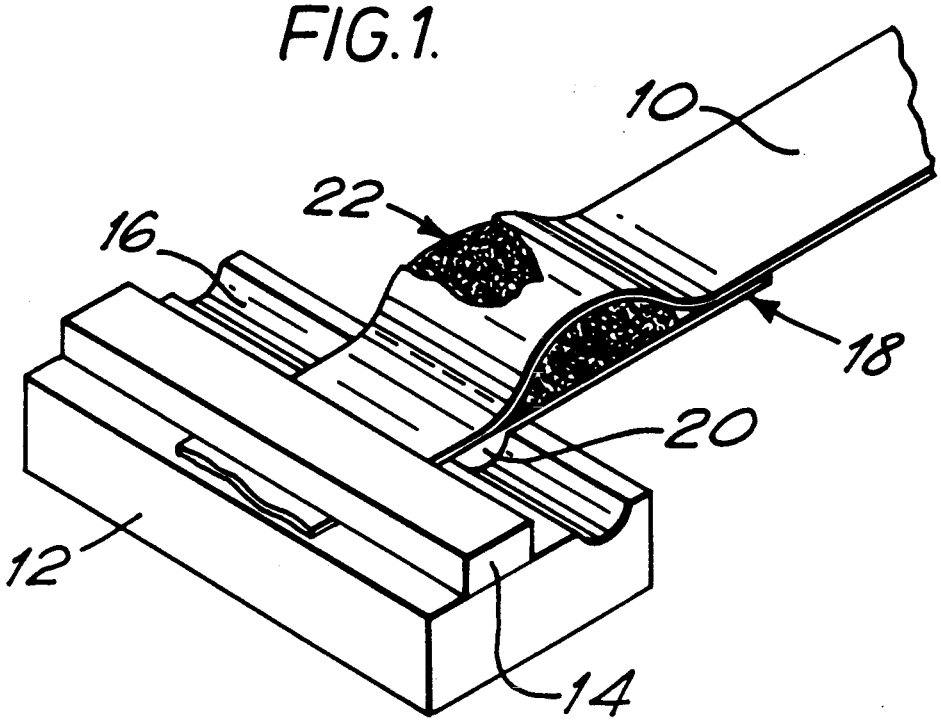
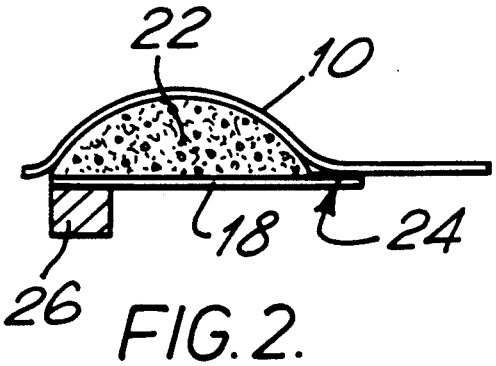
FIG. 2.
FIG. 3.
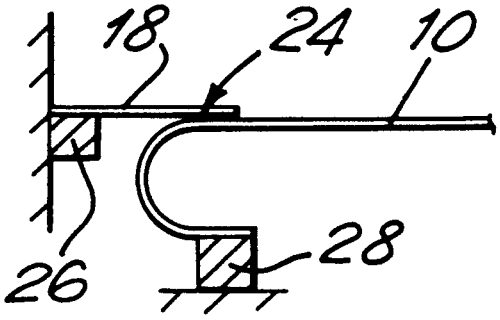

RIBBON TRANSDUCERS

This is a continuation of co-pending application Ser. No. 07/540,952, filed on Jun. 20, 1990, now abandoned.

This invention relates to ribbon transducers and is particularly concerned with the mounting of such transducers, for example in loudspeakers and microphones.

Conventionally, ribbon transducers have simply been clamped at their ends to a rigid support. Over a period of time this rigid clamping of the ends of the ribbon can lead to a fracture of the ribbon or at least to a degradation in its performance.

It is an object of the present invention to provide an improved end mounting for a ribbon transducer, particularly for a ribbon transducer to be used in a loudspeaker.

In accordance with the present invention this is achieved by the use of an end fixing which incorporates damping means.

By the provision of a damped mounting at each end of the ribbon the danger of cracking or fracturing of the ribbon is avoided or at least substantially reduced without in any way adversely affecting the performance of the transducer.

In order that the invention may be more fully understood, a number of embodiments of end mounting for the ribbon of a ribbon transducer in accordance with the invention will now be described by way of example and with reference to the accompanying drawings, in which:

FIG. 1 is an isometric view of a preferred embodiment of end mounting;

FIG. 2 is an illustration of one alternative end and mounting; and

FIG. 3 is a schematic view of a further alternative end mounting.

Referring first to FIG. 1, there is shown a ribbon foil 10 which constitutes the active element of a ribbon transducer, for example for a loudspeaker. The end portion of the ribbon foil 10 is clamped between a terminal block 12 and a clamping bar 14. The terminal block 12 is provided with a surface groove 16 of arcuate cross-section across its width. This groove 16 provides a seat for a support member 18. The support member 18 is made of a resilient material, for example silicone rubber, and may have a thickness of the order of 0.5 mm. At one end of the support member 18 is provided a bead 20 which is seated in the groove 16 as a locating means. The bead 20 may be glued in place. The other end of the support member 18 is glued or otherwise secured to the underside of the ribbon foil 10. The central portion of the support member 18 carries a foam damping pad 22 which is of generally semicircular shape in cross-section as viewed from the side of the foil. The ribbon foil 10 passes over the damping pad 22, as shown in the drawing.

This resilient/damping end mounting for the ribbon foil 10 provides the necessary security against fracture at the ends of the ribbon.

FIG. 2 shows one alternative mounting arrangement. Here, the support member 18 has one end glued to the ribbon foil 10, as indicated at 24. The other end of the support member 18 is rigidly fixed to a mounting bar 26. In this arrangement the end of the ribbon foil, after passing over the damping pad 22, extends freely. The portion of the foil 10 which passes over the damping pad 22 is glued to the pad.

FIG. 3 shows yet a further alternative end mounting. Here the end portion of the ribbon foil 10 is turned back on itself through 180° and is secured at its end to a fixed-position block 28. The one end of the support member 18 is glued, at 24, to the ribbon foil 10 and the other end of the support member 18 is fixed to a mounting block 26. This arrangement again provides a resilient damping at the end of the ribbon foil sufficient to reduce the danger of fracture.

Various other alternative methods of mounting the ribbon foil at its ends may be devised within the scope of the present invention.

It is claimed:

1. A ribbon-type transducer comprising and elongate, electrically conductive, vibratable ribbon having two oppositely disposed ends, an elastic support member at least one end of the ribbon affixed to the ribbon at a position spaced from the end of the ribbon, fixed-position mounting means fixedly holding the elastic support member at a location remote from the attachment to the ribbon, thereby to create a ribbon tail end-wise of the fixing of the support member which is relieved of stress, and a pad of damping material between the ribbon and the support member beneath the ribbon tail.

2. A ribbon-type transducer comprising an elongate, electrically conductive, vibratable ribbon having two oppositely disposed ends, an elastic support member at at least one end of the ribbon affixed to the ribbon at a position spaced from the end of the ribbon, and fixed-position mounting means fixedly holding the elastic support member at a location remote from the attachment to the ribbon, thereby to create a ribbon tail end-wise of the fixing of the support member which is relieved of stress, in which the ribbon tail is turned back on itself and which includes holding means fixedly holding the said end of the ribbon tail.

3. A ribbon-type transducer according to claim 2, in which the support member is of a resilient material.

4. A ribbon-type transducer comprising an elongate, electrically conductive, vibratable ribbon having two oppositely disposed ends, a thin strip of material constituting an elastic support member having a thickness of the order of 0.5 mm at at least one end of the ribbon affixed to the ribbon at a position spaced from the end of the ribbon, and fixed-position mounting means fixedly holding the elastic support member at a location remote from the attachment to the ribbon, thereby to create a ribbon tail end-wise of the fixing of the support member which is relieved of stress.

5. A ribbon-type transducer according to claim 4, in which the ribbon has a flat top surface and a flat underside and the support member is affixed to the underside of the ribbon.

6. A ribbon-type transducer according to claim 4, which includes clamping means clamping each end of the ribbon.

7. A ribbon-type transducer according to claim 1, which includes clamping means clamping each end of the ribbon.

8. A ribbon-type transducer according to claim 7, in which the clamping means also provides a locating means for the support member.

9. A ribbon-type transducer according to claim 1, in which the support member is a thin strip of material.

10. A ribbon-type transducer according to claim 1, in which the ribbon has a flat top surface and a flat underside and the support member is affixed to the underside of the ribbon.

* * * * *

UNITED STATES PATENT AND TRADEMARK OFFICE

CERTIFICATE OF CORRECTION

PATENT NO. : 5,243,150

DATED : September 7, 1993

INVENTOR(S) : Graham Banks

It is certified that error appears in the above-identified patent and that said Letters Patent is hereby corrected as shown below:

On the title page:
In item [76] Laurence P. Ross, executor, 35, Barham Avenue, Elstreet, should read Laurence P. Ross, executor, 35, Barham Avenue, Elstree.

Signed and Sealed this

Thirtieth Day of November, 1993

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. :5,243,150
DATED :September 7, 1993
INVENTOR(S) :Graham Bank, et. al.

It is certified that error appears in the above-indentified patent and that said Letters Patent is hereby corrected as shown below:

Column 2, line 14 change "and" to --an--.

Column 2, line 16: insert --at-- after "at".

Signed and Sealed this

Fifth Day of April, 1994

Bruce Lehman

*Attest:*

BRUCE LEHMAN

*Attesting Officer*

*Commissioner of Patents and Trademarks*